US005611450A

United States Patent [19]

DeMars

[11] Patent Number: 5,611,450

[45] Date of Patent: Mar. 18, 1997

[54] TRASH RECEPTACLE WITH BUILT-IN DUSTPAN AND BROOM

[76] Inventor: Robert A. DeMars, 23221 Ladrillo Ave., Woodland Hills, Calif. 91367

[21] Appl. No.: 645,293

[22] Filed: May 13, 1996

[51] Int. Cl.[6] ..... B65D 90/00

[52] U.S. Cl. ..... 220/334; 220/908; 15/257.3

[58] Field of Search ..... 220/334, 908; 15/257.1–257.4

[56] References Cited

U.S. PATENT DOCUMENTS

| | | | |
|---|---|---|---|
| D. 217,498 | 5/1970 | Dilyard | D49/35 |
| D. 246,566 | 12/1977 | Van Skiver | D7/194 |
| D. 281,111 | 10/1985 | McClelland | D34/8 |
| D. 293,843 | 1/1988 | Kroll et al. | D34/8 |
| D. 297,875 | 9/1988 | Carville | D34/11 |
| D. 308,273 | 5/1990 | Hanna | D34/11 |
| D. 321,576 | 11/1991 | Hradinsky | D34/8 |
| D. 322,350 | 12/1991 | Craft, Jr. et al. | D34/9 |
| D. 326,343 | 5/1992 | Hradinsky | D34/7 |
| D. 326,754 | 6/1992 | Hradinsky | D34/7 |
| D. 335,562 | 5/1993 | Evans | D34/7 |
| D. 351,705 | 10/1994 | Bird et al. | D34/11 |
| 675,052 | 5/1901 | Carlson . | |
| 908,558 | 1/1909 | Gildemeister . | |
| 1,908,730 | 5/1933 | Caldwell . | |
| 2,750,246 | 6/1956 | Fuerst . | |
| 3,083,859 | 4/1963 | Gardiner | 220/30 |
| 3,156,941 | 11/1964 | Tomaivolo | 15/257.1 |
| 3,170,183 | 2/1965 | Leatherman | 15/257.1 |
| 3,382,523 | 5/1968 | Parisson | 15/257.2 |
| 3,390,804 | 7/1968 | Morgan | 220/32 |
| 3,408,681 | 11/1968 | Zsakson | 15/257.2 |
| 4,317,605 | 3/1982 | Alissandratos | 312/206 |
| 4,600,113 | 7/1986 | DeMars | 220/1 T |
| 4,782,970 | 11/1988 | Edwards | 220/1 R |
| 4,802,258 | 2/1989 | Jensen | 15/257.1 |
| 4,907,710 | 3/1990 | Bulkens | 220/1 T |
| 5,172,823 | 12/1992 | Moettelli | 220/334 |
| 5,379,481 | 1/1995 | DeMars | 15/257.4 |
| 5,407,089 | 4/1995 | Bird et al. | 220/212.5 |

*Primary Examiner*—Joseph M. Moy
*Attorney, Agent, or Firm*—Jack C. Munro

[57] ABSTRACT

A trash receptacle in the form of a housing which has a lid covering the access opening into the internal chamber of the housing. The lid includes a dustpan. The dustpan is formed of an upper leg which is connected at approximately a ninety degree angle to the lower leg. The dustpan is to be removable from the lid and receptacle and turned upside down and used to collect loose debris by the loose debris being swept onto the interior surface of the dustpan. The housing of the trash receptacle has a recess arrangement formed in the exterior wall surface of the trash receptacle. The recess arrangement is basically in the shape of a conventional broom. The broom is to snappingly engage with the recess arrangement and be stored therein when not in use. The broom is to be removable from the recess arrangement to be used.

5 Claims, 1 Drawing Sheet

TRASH RECEPTACLE WITH BUILT-IN DUSTPAN AND BROOM

BACKGROUND OF THE INVENTION

1) FIELD OF THE INVENTION

The field of this invention relates to appliances to facilitate cleaning of floors within homes and businesses and more particularly to a combination trash receptacle, dustpan and broom. The dustpan and broom can be removed from the trash receptacle and utilized to collect loose debris which is to be deposited within the trash receptacle.

2) DESCRIPTION OF THE PRIOR ART

Common appliances for collecting of loose debris are a broom and a dustpan. Loose debris is normally swept from a floor onto a dustpan and then the loose debris is carried in the dustpan and then is deposited from the dustpan to within a trash receptacle. The broom and the dustpan may be stored at a location which is not convenient relative to the trash receptacle, causing many trips to same.

In an effort to make the collecting and storing of trash convenient, it has been common to incorporate a dustpan in conjunction with a trash receptacle. The dustpan may actually be part of the trash receptacle and function as a lid to close the trash receptacle during the time it is not being used. The lid is to be removable from the trash receptacle and utilizable as a dustpan. However, in the past, such combined trash receptacles and dustpans have not been designed to function in the most efficient manner.

Also, trash receptacles of the prior art have been known to include a broom with the broom being mounted on the side of the trash receptacle. However, such attachment of a broom to the side of the trash receptacle is not attractive in appearance which makes the combined trash receptacle and broom unappealing. Also, the trash receptacle with the attached broom locates the broom in such a manner that it can interfere with the depositing of trash within the trash receptacle.

SUMMARY OF THE INVENTION

A trash receptacle formed of a thin sheet material housing which has an internal chamber. The internal chamber is open at its upper end forming an access opening. The access opening is normally closed by means of a lid. The lid includes a dustpan with the dustpan being pivotally movable on the lid from a normally closed position to an open position so that when the dustpan is not being used, debris can be deposited through the access opening into the internal chamber of the trash receptacle. The dustpan is formed of two sheet material leg members which are connected together in an L-shaped arrangement. Formed within one of the leg members is a handle which facilitates manual grasping of the dustpan and its disengagement from the lid. The dustpan is to be turned upside down with loose debris to be swept onto the interior surface of the lower leg of the dustpan. The upper leg functions as a backstop when collecting of loose debris on the lower leg. A broom is to be utilized to affect the sweeping of loose debris onto the dustpan. Formed on the exterior surface of the housing of the trash receptacle is a recess arrangement which is substantially similar to the shape of the broom. The recess arrangement includes a necked-down area formed within the portion of the recess arrangement that is to accommodate the handle of the broom. The handle of the broom is to be snappingly engaged with the necked-down area thereby securing in position the broom with the trash receptacle when not in use.

One of the primary objectives of the present invention is to incorporate into a single unit a trash receptacle, a dustpan and a broom.

Another objective of the present invention is to construct a trash receptacle which can be portable to the location of the debris and which facilitates the picking up and discarding of loose debris with the appliances used for such picking up to be directly mounted in conjunction with the trash receptacle.

Another objective of the present invention is to construct a trash receptacle which includes both a dustpan and a broom which are stored when not in use in conjunction with the trash receptacle in a manner convenient to the trash receptacle and also in an attractive manner.

Another objective of the present invention is to construct a trash receptacle which includes a dustpan and broom which can be manufactured at a reasonable cost and thereby sold at a reasonable cost to the consumer.

DETAILED DESCRIPTION OF THE PREFERRED EMBODIMENT

Figure 1:
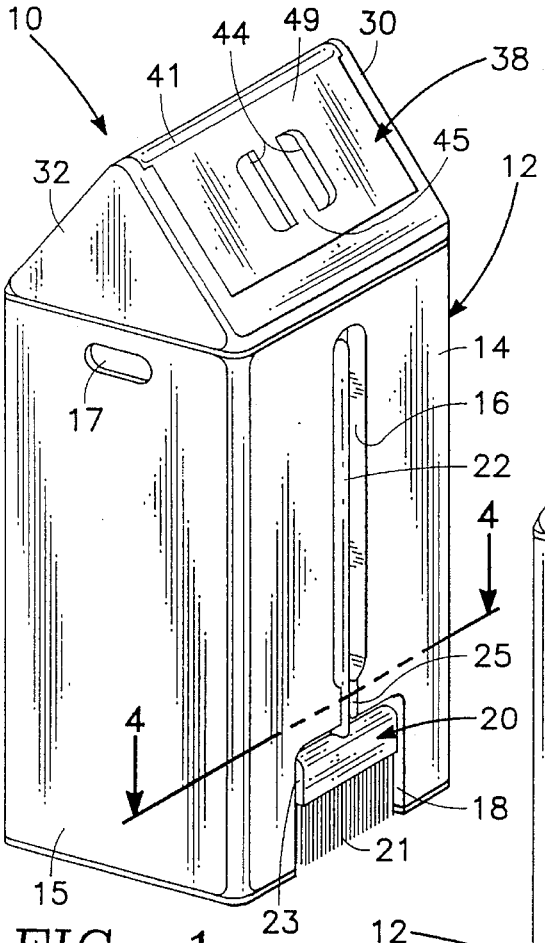
FIG. 1 is an isometric view of the trash receptacle of the present invention showing the broom and the dustpan located in their normal storage positions.

Referring particularly to the drawings, there is shown the trash receptacle 10 of this invention. The trash receptacle 10 includes a sheet material housing 12 which is formed of a plurality of rectangularly shaped sidewalls such as sidewalls 14 and 15. Sidewall 14 has formed therein a recess arrangement in the form of handle recess 16 and broom head recess 18. The handle recess 16 includes a narrowed section 24 which includes a necked-down section 25. The handle 22 of a broom 20 is to be locatable within the handle recess 16. A portion of the handle 22 is located within the narrowed section 24. The necked-down section 25 defines a space there between which is slightly narrower than the diameter of the handle 22. The result is the handle 22 must be forcefully inserted within the handle recess 16 with the necked-down section 25 functioning to securely hold in position the handle 22 when located within the handle recess 16 and the narrowed section 24. The head 23 and the bristles 21 of the broom 20 are to be located within the broom head recess 18. It is to be understood that the broom 20 is to be manually disconnected from the recesses 16 and 18 so as to facilitate usage of the broom 20. Sidewall 15 also has a handle recess 17 which is to be used with a similar recess (not shown) on the opposite sidewall to lift and carry the receptacle 12.

Trash receptacle 10 includes an internal chamber 11. Access into internal chamber 11 is accomplished through an access opening 26. The lid of the trash receptacle 12 includes a ledge 28 surrounding access opening 26. Mounted on the ledge 28 at opposite ends thereof are triangularly-shaped side panels 30 and 32. The triangularly-shaped side panels 30 and 32 are located in a facing relationship with circular recess 34 of the triangularly-shaped side panel 30 facing circular recess 36 of the triangularly-shaped side panel 32. Rounded protrusion 40 of a dustpan 38 is to connect with recess 36. In a similar manner, rounded protrusion 42 of dustpan 38 is to connect with recess 34. The dustpan 38 is then mounted in recesses 36 and 34 between the triangularly-shaped side panels 30 and 32 and functions to close the access opening 26. The dustpan 38 can be manually deflected with pivoting occurring by means of the rounded protrusions 40 and 42 in their respective recesses 36 and 34. Pivoting of dustpan 38 on the rounded protrusions will locate the dustpan 38 in the open position permitting access past the deflected dustpan 38 through the access opening 26 into the internal chamber 11.

Figure 2:
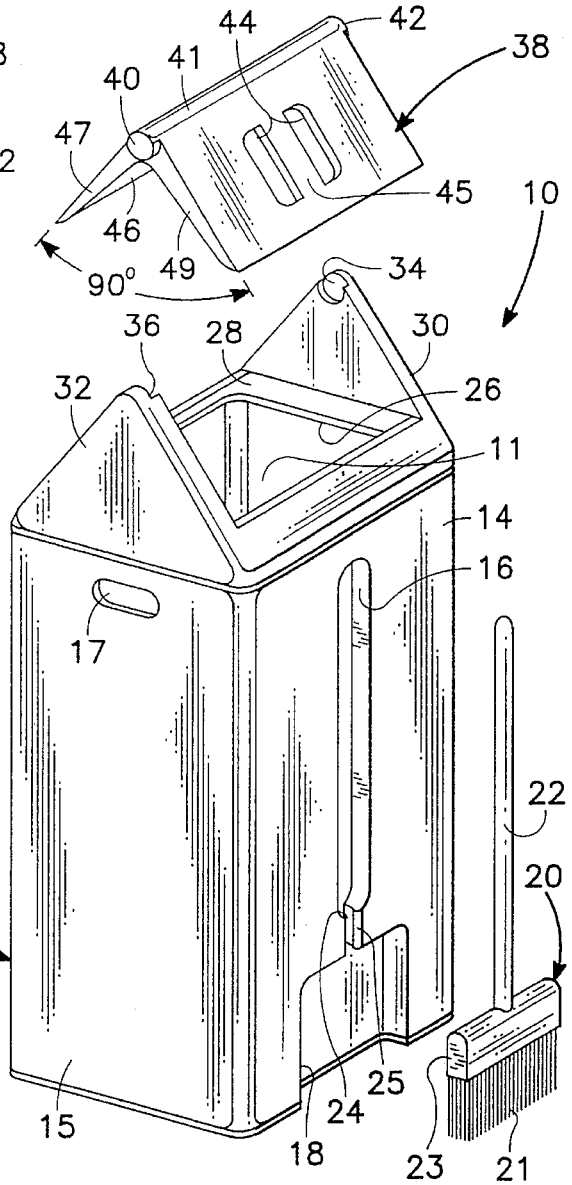
FIG. 2 is an isometric view similar to FIG. 1 but showing the broom and the dustpan disengaged from the trash receptacle.
Figure 3:
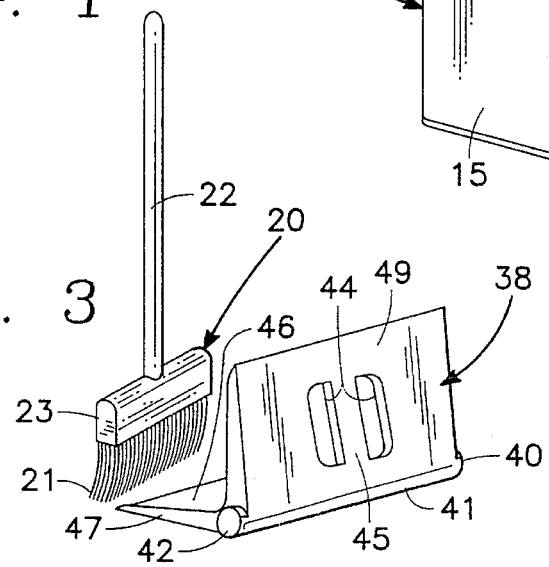
FIG. 3 is a view depicting usage of the broom and dustpan in order to pick up loose debris.
Figure 4:
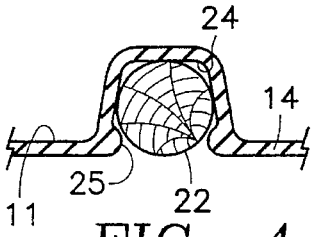
FIG. 4 is a cross-sectional view taken along line 4—4 of FIG. 1 through a portion of the trash receptacle which shows more clearly the securing arrangement for the broom when stored.

The dustpan 38 is basically L-shaped defining a planer lower leg 47 and a planer upper leg 49. The planer upper leg 49 is connected to the planer lower leg 47 at the apex 41 with the planer upper leg 49 being located substantially at a right angle to the planer lower leg 47. This right angle arrangement is depicted by means of the ninety degree representation in FIG. 2. The planer lower leg 47 has an interior surface 46. The upper planer leg 49 has formed therein a pair of handle depressions 44. The handle depressions 44 are separated by a wall 45.

The user is to place his or her fingers within one of the handle depressions 44 and his or her thumb in the opposite handle depression 44 and affect a squeezing action against the wall 45. This will permit the user to lift the dustpan 38 from the triangularly-shaped side panels 30 and 32. The user then is to turn the dustpan 38 upside down placing the exterior surface of the lower planer leg 47 in contact with a supporting surface such as a floor. The broom 20 is to be disconnected from the handle recesses 16 and 18 with the bristles 21 of the broom head 23 to be used to sweep loose debris from the floor onto the interior surface 46 of the dustpan 38. The upper leg 49 functions as a backstop for the collecting of that debris. Once the desired amount of debris has been collected on the dustpan 38, that debris is then to be deposited through the access opening 26 into the internal chamber 11 of the trash receptacle 10. The dustpan 38 is then to be again turned upside down and repositioned in contact with the triangularly-shaped side panels 30 and 32 as is shown in FIG. 1 of the drawing. After usage of the dustpan 38, the broom 20 is to be reconnected into the stored position in conjunction with the recesses 16 and 18.

What is claimed is:

1. A trash receptacle with built-in dustpan and broom comprising:

a trash receptacle housing having an internal chamber adapted to receive trash, an access opening formed in said housing providing access into said internal chamber, a lid mounted on said housing about said access opening, said lid including a dustpan, said dustpan closing said access opening when at rest, said dustpan being pivotally movable to a deflected position to provide access through said access opening into said internal chamber, said dustpan having an exterior surface and an interior surface, said dustpan being composed of a lower leg and an upper leg connected together at an apex, said dustpan being removable from said lid and turned upside down and when placed against a supporting surface movement of loose debris onto said interior surface of said lower leg is permitted, said upper leg extending from said lower leg at approximately ninety degrees which positions said upper leg to function as a backstop for debris as it is swept onto said lower leg.

2. The trash receptacle as defined in claim 1 wherein:

said upper leg being the same length as said lower leg.

3. The trash receptacle as defined in claim 1 wherein:

a handle mounted on said upper leg, said handle facilitating removing of said dustpan and positioning of said dustpan to collect loose debris.

4. The trash receptacle as defined in claim 1 wherein:

said housing having an exterior surface, a recess arrangement formed within said exterior surface of said housing, said recess arrangement to function as a storage chamber for a broom.

5. The trash receptacle as defined in claim 4 wherein:

said broom having an elongated thin handle, said recess arrangement having a necked-down area, said elongated thin handle to snappingly engage with said necked-down area to securely mount said broom within said recess arrangement when said broom is to be stored.

* * * * *